US005138297A

United States Patent [19]

Hollweck

[11] Patent Number: 5,138,297

[45] Date of Patent: Aug. 11, 1992

[54] FUSED ELECTRICAL SWITCHGEAR

[75] Inventor: Walter Hollweck, Heroldsberg, Fed. Rep. of Germany

[73] Assignee: Inter Control Hermann Kohler Electrik GmbH & Co. KG, Nuremberg, Fed. Rep. of Germany

[21] Appl. No.: 644,847

[22] Filed: Jan. 23, 1991

[30] Foreign Application Priority Data

Jan. 23, 1990 [DE] Fed. Rep. of Germany ..... 4001790

[51] Int. Cl.[5] ..... H01H 37/52; H01H 37/76

[52] U.S. Cl. ..... 337/354; 29/622; 337/401; 337/360; 337/298

[58] Field of Search ..... 337/354, 360, 299, 347, 337/368, 298, 401; 200/83 J; 29/622, 623

[56] References Cited

U.S. PATENT DOCUMENTS 4,307,370 12/1981 Hollweck ..... 337/299

*Primary Examiner*—Harold Broome

*Attorney, Agent, or Firm*—Robin, Blecker, Daley & Driscoll

[57] ABSTRACT

Electrical switchgear apparatus comprises a base, a switching circuit element supported by the base and including at least one movable circuit element part, a thermal trip supported by the base for tripping motion in a given direction with respect to the movable circuit element part and a transmission device for imparting the tripping motion to the movable circuit element part, the transmission device comprising first and second members movable with respect to one another in the given direction to define a desired composite length for the transmission device in the given direction.

13 Claims, 3 Drawing Sheets

FUSED ELECTRICAL SWITCHGEAR

FIELD OF THE INVENTION

This invention relates generally to switchgear and pertains particularly to electrical switchgear of the fused variety.

BACKGROUND OF THE INVENTION

A known thermal fuse for electrical equipment with a base part made of insulating material is described in German Patent 28 26 205. On one side of the base part, there are a fixed contact and a moving contact fastened to the free end of a contact spring, and on the other side of the base part, there is a thermal trip whose tripping motion can be transmitted to the contact spring by a transmission pin guided in the base part. The thermal trip in the thermal fuse is a fusible material insert, for example, whose tripping motion is effected by the surface of the initially rigid fusible material insert dropping down when an overheating temperature is exceeded. Thus, the fusible material melts, so that the transmission pin can move downwardly under the pressure of the contact spring. Therefore, the tripping motion of the fusible material insert is transmitted to the contact spring.

Such transmission pins are also used in electrical switchgear with other thermal trips, for example in switches that are switched by bimetallic snap discs, capillary tube pressure cells, or other actuators wherein a transmission pin provided in a base of any design transmits a motion of a trip device to a switching member.

To provide reproducible switching conditions in such switchgear, there is a need to match the length of the longitudinally movable transmission pin as exactly as possible to the features of the switchgear, especially to the tolerances of the base part made of insulating material, for example, ceramic, and to the features and design of the tripping elements, for example snap discs and the like. Additional tolerances also appear in the assembly of such a switch, that have to be taken into consideration by a selective and individual cutting to length of the transmission pin. Otherwise the contact conditions may not correspond to the specifications. Contact pressures may be too high or too low or, for example, the opening path of a switch is inadequate.

In the state of the art, the procedure is usually to have available a number of transmission pins of different lengths, to measure the features inside the preassembled switch with a gauge during the assembly process, and then to introduce a pin of suitable length. This necessarily requires the availability of a number of sorted pins of different lengths which then have to be selected during the assembly process and introduced into the preassembled switch. It is complicated and expensive to maintain supplies and to select such pins of different lengths.

Besides this described method, to provide definite switching conditions, it has also been attempted to crush housing parts such as mounting plates and the like in the sense of a positive or negative "length change". Of course, such effects on the housing can be inspected only with difficulty and are poorly reproducible.

It has also already been attempted to vary the distance between the ends of the moving contact and the fixed contact. By crushing the fixed contact more or less against the movable contact kept away from it forcibly, some tolerance compensation can also be achieved, but the selective bending of contact springs has a negative effect on resiliency characteristics.

It is also known to grind pins at their ends during the machining process to achieve exact matching of the pin length to the features of the base or of the other switch components.

Finally, there are also glass pins of changeable length in the state of the art, whose length can be adapted to the housing features by heating and axially oriented crushing pressure.

All of these procedures have drawbacks inasmuch as they require large inventories and especially do not permit fast cycle times during the assembly process.

SUMMARY OF THE INVENTION

The object of this invention is to further develop an electrical switchgear of the type above discussed, but wherein the assembly expense is reduced and assembly cycle time is improved.

In attaining this object, the invention provides electrical switchgear apparatus which comprises a base, a switching circuit element supported by the base and including at least one movable circuit element part, a thermal trip supported by the base for tripping motion in a given direction with respect to the movable circuit element part and a transmission device for imparting the tripping motion to the movable circuit element part, the transmission device comprising first and second members movable with respect to one another in the given direction to define a desired composite length for the transmission device in the given direction.

Thus, a transmission pin is formed of two parts and is of changeable length because of the fact that one part can be pressed into the other part by exerting axial pressure. It is possible with such two-part transmission pins to preassemble the transmission pins with excess length, introduce them into switch bases that are also preassembled, and then to exert pressure in opposite directions on the elements impacting the ends of the pin, for example a bimetallic snap disc on the one hand and the contact spring on the other, which leads to selective shortening of the transmission pin without the necessity of taking complicated steps. Pressure can be exerted, for example, during the attachment of heat transfer plates, retainers, or the like, so that the additional expense for the length reduction is minimized.

The two parts of the transmission pin can be telescoped into one another. "Telescoped", for example, means that the first part is a pin and the second part is a sleeve part or a quasi-sleeve part. The one part can beneficially be an pin of electrically insulative material and the other part a metallic sleeve that surrounds one end of the insulating pin. This choice of materials on the one hand guarantees electrical and thermal insulation, and on the other hand, the metallic sleeve assures that in spite of relatively rigid seating of the sleeve around the end of the insulating pin, a telescopic motion of the two parts, one into the other, can occur without the risk of destroying one of the parts.

Under some circumstances, it is advantageous to design the metallic sleeve directly as a fusible solder insert. However, it is also possible to embed a separate sleeve in a fusible solder insert so that the motion occurs between the pin and the sleeve, and only upon response of the fusible solder insert, i.e., when the melting point is exceeded, the sleeve and the pin sink further into the fusible solder insert by displacing the fusible solder, and the fuse function is thereby satisfied.

To prevent the fusible solder insert from being damaged or at least crushed during the shortening of the pin-fusible solder combination, a cavity may be provided in the axial extension area of the pin, whose diameter is slightly smaller than the diameter of the pin.

If the end of the pin located in the sleeve is conical, spherical, or rounded, it is assured that the pin can be pressed into the sleeve without damage and that a uniform radial deformation of the sleeve material occurs.

The sleeve can be of cup-shaped design or can also be slightly conical with a taper toward the end of the sleeve away from the pin. Overall, it is important for the sleeve to be made of deformable material, since then the pin can be of sufficiently stiff design. However, to this end the sleeve may also not be made of deformable material, but of elastic material, and for example can be provided with a spring cutout in the form of a spring slot, so that the slotted sleeve surrounds the end of the pin elastically.

To provide permanently for a relatively solid connection between the pin and sleeve, the inner surface of the sleeve may be provided with projections or teeth or the like. Alternatively, it is also possible to provide the outer surface of the pin with corresponding elements.

When the end of the sleeve away from the pin is provided with a radial projection, the sleeve can be gripped better by an automatic machine for introducing the pin-sleeve combination, so that it is substantially easier to handle the transmission pin.

Under some circumstances, it is advantageous for the preassembly of the insulative pin and sleeve to flare the guide end of the sleeve facing the insulating pin like a trumpet.

If the pin is placed in a first bore in the base part and the sleeve in a second bore flush with the first bore, whose diameter is somewhat larger than the first bore, this assures that the transmission pin as a whole is guided reliably in the axial direction in the base part.

A method of manufacture accordance with the invention achieves a substantial simplification of the assembly of such a switch.

The invention will be described in detail in the drawings with reference to examples of embodiment.

DETAILED DESCRIPTION OF PREFERRED EMBODIMENTS AND PRACTICES

Figure 1:
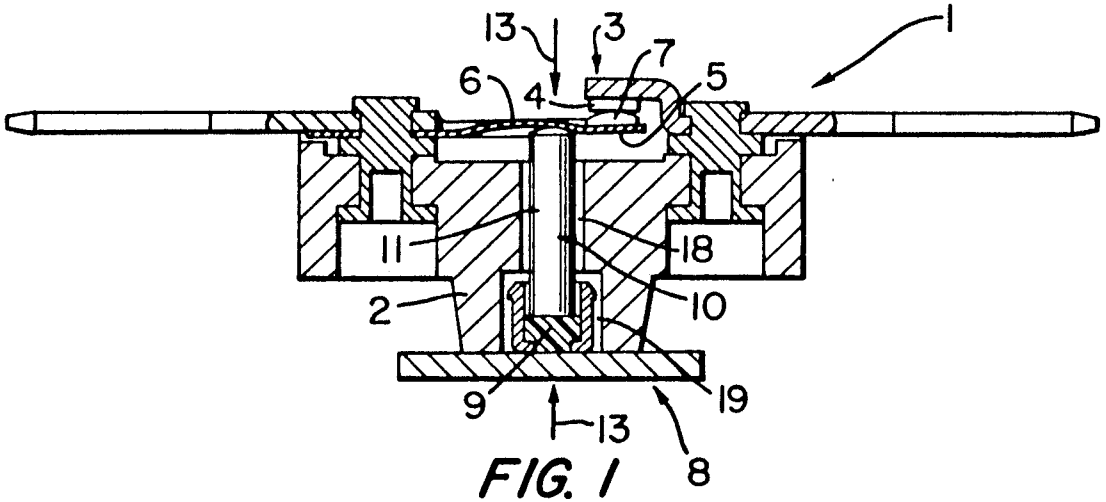
FIG. 1 is a central longitudinal cross section of an electrical switchgear with a transmission pin of changeable length and a fusible solder insert.

In FIG. 1, the switchgear 1 pursuant to the invention comprises a base part, i.e., an insulating base 2, on one side 3 of which there are a fixed contact 4 and a moving contact 7 fastened to the free end 5 of a contact spring 5, and on the other side 8 of which there is a thermal trip in the form of a fusible solder insert 9 whose tripping motion can be transmitted to the contact spring 6 by means of a transmission pin 10 guided in the insulating base 2.

The transmission pin 10 comprises the parts 11 and 9 and is designed with changeable length by providing that the part 11 can be pressed into the fusible solder insert constituting a sleeve by exerting axial pressure in the direction of the arrows 13.

Figure 2:
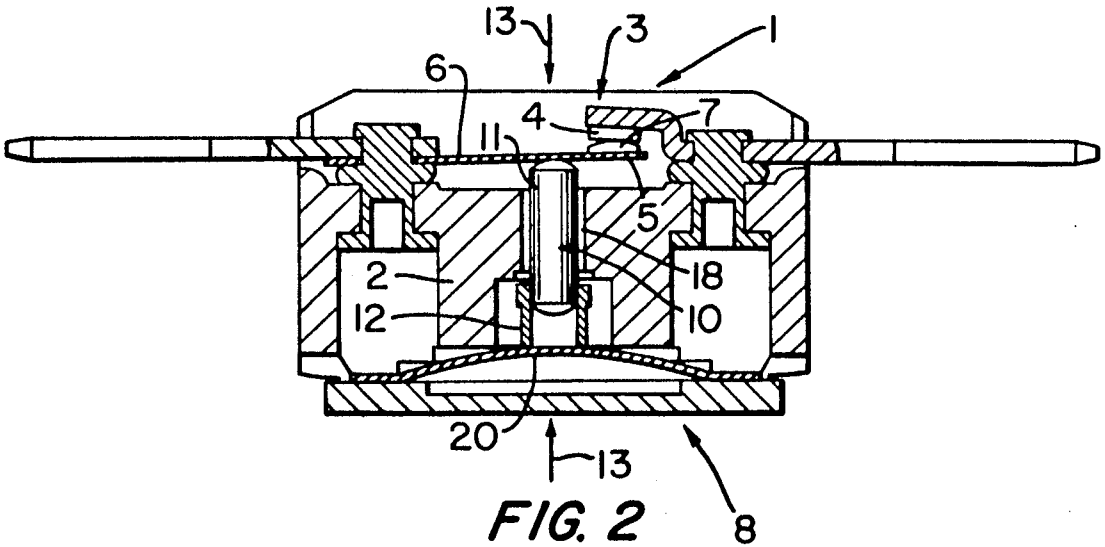
FIG. 2 is an example of a switchgear modified from that of FIG. 1.

FIG. 2 shows another example of an embodiment of electrical switchgear with a transmission pin designed to have changeable length, with this switchgear essentially having the same components as the example of embodiment of FIG. 1, but in this case with a bimetallic snap disc 20 being provided instead of a fusible solder insert 9 (as in FIG. 1), which is located beneath the part 12 of the transmission pin 10 and acts together with this part 12.

Figure 3:
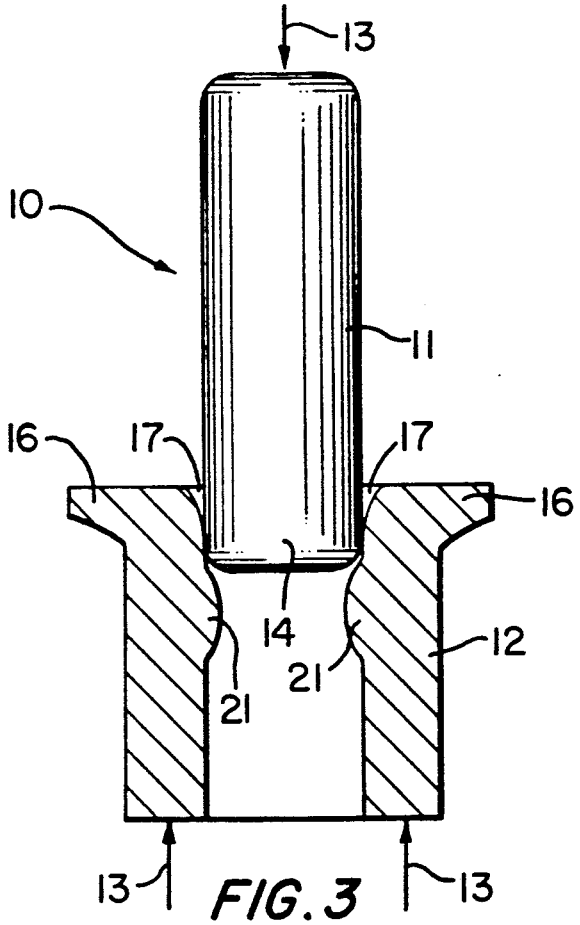
FIG. 3 is a detailed view of a transmission pin in preassembled condition.
Figure 4:
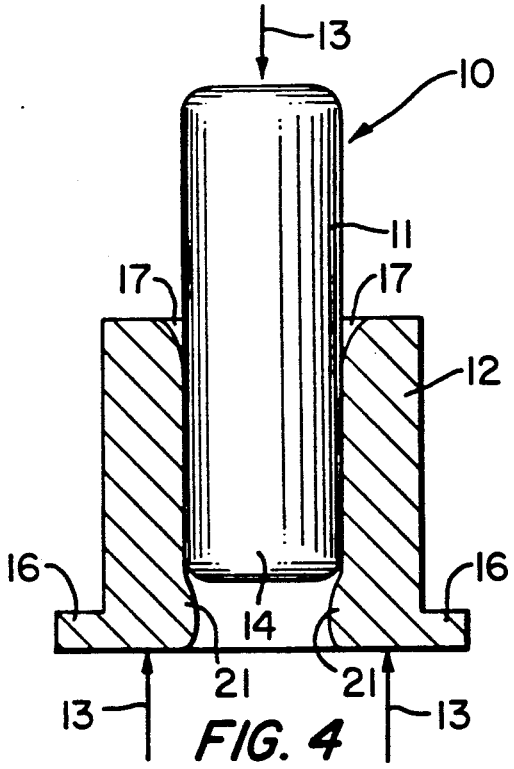
FIG. 4 is a detailed view of a transmission pin set to a proper length.

As can be seen more specifically in FIGS. 3 and 4, the two parts 11 and 12 of the transmission pin 10 are telescoped into one another. Part 11 is an insulating pin, and part 12 is a metallic sleeve that surrounds the bottom end 14 of the insulating pin.

The length of the sleeve 12 is about 20 to 50% of the length of the insulating pin. The inside diameter of the sleeve 12 compared to the diameter of the insulating pin 11 is of such a dimension that it can be pressed into the sleeve 12 only with radial deformation of the sleeve material. The end 14 of the insulating pin is conical, spherical, or rounded, and therefore has sliding inclined surfaces that can somewhat press the sleeve material apart when pressure is exerted on the transmission pin 10 in the direction of the arrow 13.

The sleeve 12 can be made of deformable material, which is expanded and deformed somewhat radially by pressing the insulating pin 11 therein. The sleeve may be made of elastic material, for example spring steel, and be provided with a spring cutout in detail. It is important for the part 11 to be held in part 12 with a clamping seat that is sufficiently strong for the transmission pin 10 to be able to perform fully its transmission function inside the insulating base.

It is also possible to provide projections or teeth or the like in the area of the clamping seat surfaces, for example on the inner surface of the sleeve or on the outer surface of the insulating pin, to increase the friction between these two parts if desired.

It can be seen in FIGS. 3 and 4 that either the end of the sleeve 12 away from the insulating pin 11 or that facing it can be provided with a radial projection 16, which simplifies handling the pin/sleeve unit during the assembly process in the insulating base. FIGS. 3 and 4 also show that the insertion end 17 of the sleeve 12 facing the part 11 is flared like a trumpet.

FIGS. 3 and 4 also show that the part 12 can have a deformation 21 pointing radially inward in the area facing the bottom 14 of the part 11, for example of the type of an internal bulge on the inner circumference of part 12. As a result of this, when part 11 is inserted into the interior of part 12, the bulge 21 is pushed by the bottom end 14 of part 11 just ahead of part 11 during the pressing process, in a wave-like manner, such that ultimately this inner bulge 21 is moved to the lower area of the sleeve-shaped part 12, assuming that the part 12 consists of a deformable material. This leads to improved support at the end of the pressing, which is important inasmuch as the stability conditions inside the transmission pin 10 after the pressing process and thus also after incorporation of the transmission pin 10 into the actual switchgear 1 (see FIG. 1 or 2) can no longer be inspected. The bulge 21 and the bulge support produced by it are also important, however, because temperature ranges up to about 400 and 500° C. can be checked and switched with thermal switches, temperature ranges in which the different coefficients of expansion of materials used play a role. For example, when a metallic sleeve (part 12) expands more severely than an insulating pin, loosening can occur, which can have serious consequences under some circumstances.

With reference to FIG. 1, it can also be seen that the insulating pin, namely part 11, is located in a first bore 18 in the insulating base 2, and the fusible solder insert 9, which somewhat forms the sleeve of the pin, is located in a second bore 19 whose diameter is larger than that of the first bore.

Figure 5:
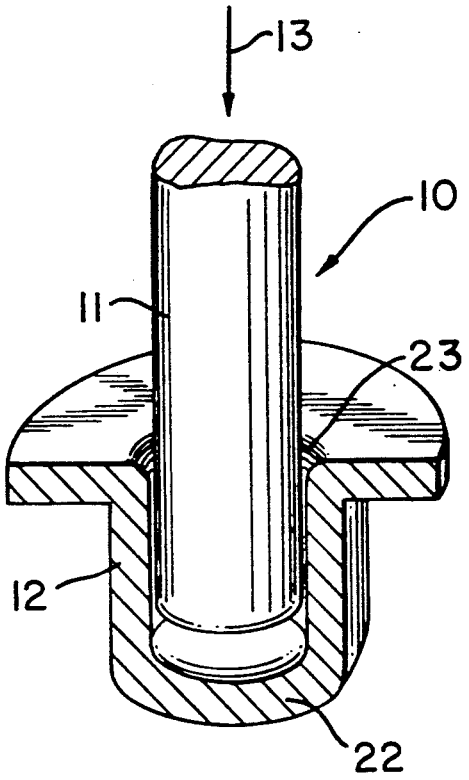
FIG. 5 is another example of an embodiment of a transmission pin.
Figure 6:
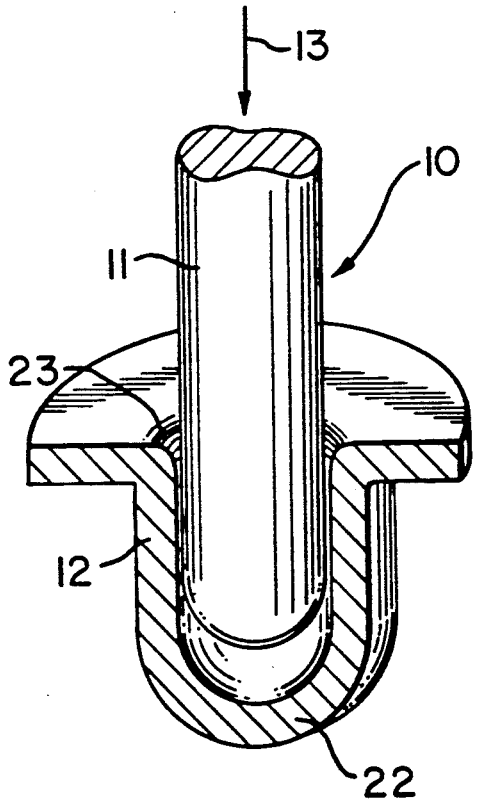
FIG. 6 is further example of an embodiment modified from that of FIG. 5.

In the examples of embodiment of a transmission 10 according to FIGS. 5 and 6, it is provided that part 12 has an essentially cup-shaped design and is provided in the area of its upper opening with a beaded rim 23, while part 12 at its lower area has a bent or crowned bottom 22. Definite length relationships result from this configuration.

The other part 11 of the transmission device or pin 10 in turn is pressed into the cup-shaped part 12 by exerting axial pressure in the direction of the arrow 13, because of which the transmission pin 10 is of changeable length. In the examples of embodiment according to FIGS. 5 and 6, a transmission pin 10 with no fusible solder insert is used in each case. The design of the cup-shaped sleeve part 12 according to FIG. 6, in departure from the design of FIG. 5, has a bottom 22 that is more strongly crowned toward the outside, or practically round.

It has been mentioned above that the transmission pin 10 comprises two parts 11 and 12, with the one part 11 being able to be pressed into the other part 12 by exerting axial pressure. In particular, part 12 has been defined as a sleeve part or a quasi-sleeve part, for which it should be understood with this wording that part 12 does not have to be a basically hollow and relatively thin-walled element, but part 12 might also be comprised of flowing solid material with a quasi-sleeve function, for example one into which a plastic pin or other solid pin part 11 can be pressed, but with the precondition that the flowable solid material of part 12 is held in any suitable manner so that it can execute its intended flow motion, which then ultimately leads to shortening the pin and changing its length. Thus, it should also be understood that it is not necessary for part 12 to be in the form of a hollow sleeve from the start, and that it is also not necessary for the outside diameter of this part 12 always to have the same value. Therefore, it is also definitely feasible for part 12 initially to be conical, for example, and then to be formed into a quasi-sleeve shaped element during the pressing process, provided only that it is possible to achieve a length change of the transmission pin in the sense of this invention. Naturally, the connection of the two parts 11 and 12 of the transmission pin has to be guaranteed. Therefore, from this it follows that part 12 can initially be present in various configurations. For example, it can initially be open, closed, or in the form of a solid body, but it can also be an open, resilient element, or a closed element slotted in its upper area. It is only important, as stated above, for two parts 11 and 12 constituting a transmission pin 10 in a switchgear to be able to be pressed into one another to overcome tolerance problems that can occur in switchgear, especially electrical switchgear.

The invention also provides a method for the manufacture of electrical switchgear of the subject type comprising the following steps: producing the base, the switching circuit element, the thermal trip device and the transmission device, wherein the transmission device is produced in two parts comprising respectively a pin and a sleeve; preassembling the base, the switching circuit element and the thermal trip device to provide a subassembly; determining from the subassembly a first length, the first length being that required for the transmission device to properly impart the tripping motion to the movable circuit element in the final assembly of the switchgear; assembling the transmission device by inserting an end of the pin into the sleeve to an extent providing the transmission device with a second length in excess of a the first length; inserting the transmission device into a length shortening device and effecting a telescoping of the pin into the sleeve to provide the transmission device with a length equal to the first length; and inserting the transmission device into the subassembly to provide the final assembly.

The method may be practiced by the use of a swaging device, wherein information of the first length is provided to the swaging device, by introducing a measuring gauge into the subassembly. The method may further be practiced wherein the transmission pin is selected to be of an electrically insulative material.

What is claimed is:

1. Electrical switchgear apparatus comprising:

(a) a base;

(b) a switching circuit element supported by said base and including at least one movable circuit element part;

(c) thermal trip means supported by said base for tripping motion in a given direction with respect to said movable circuit element part; and (d) transmission means intervening said switching circuit element and said thermal trip means for imparting said tripping motion to said movable circuit element part, said transmission means comprising first and second interfitted members which have been moved with respect to one another in said given direction to define a desired composite length for said transmission means in said given direction.

2. The invention claimed in claim 1 wherein said first and second members are in mutual telescopic relation.

3. The invention claimed in claim 1 wherein said first member is a pin-shaped member and wherein said second member is a sleeve-shaped member adapted for the receipt of said first member.

4. The invention claimed in claim 2 wherein said first member is a pin-shaped member and wherein said second member is a sleeve-shaped member adapted for the receipt of said first member.

5. The invention claimed in claim 1 wherein said second member is comprised of a metallic sleeve.

6. The invention claimed in claim 5 wherein said metallic sleeve comprises a fusible solder insert.

7. The invention claimed in claim 3 wherein said first member is of a first diameter and wherein said second member is of a second diameter less than said first diameter.

8. The invention claimed in claim 7 wherein said second member is comprised of a deformable material and accommodates the receipt of said first member by second member deformation.

9. The invention claimed in claim 2 wherein the shape of an end of said first member adapted for entry into said second member has a configuration selected from the configuration group consisting of conical, spherical and round configurations.

10. The invention claimed in claim 2 wherein said second member is cup-shaped.

11. The invention claimed in claim 2 wherein said second member is comprised of elastic material.

12. In a method for the manufacture of electrical switchgear of the type having a base, a switching circuit element supported by said base and including at least one movable circuit element part, thermal trip means supported by said base for tripping motion in a given direction with respect to said movable circuit element part, and transmission means including a pin and a sleeve intervening said switching circuit element and said thermal trip means and movable in said base for imparting said tripping motion to said movable circuit element part, the steps of (a) determining a first length, said first length being that required for said transmission means to properly impart said tripping motion to said movable circuit element in said switchgear;

(b) assembling said transmission means by inserting an end of said pin into said sleeve to an extent providing said transmission means with a second length in excess of said first length; and (c) effecting a telescoping of said pin into said sleeve to provide said transmission means with a length equal to said first length.

13. The method of claim 12 wherein said transmission pin is selected to be of an electrically insulative material.

* * * * *